United States Patent [19]

Castaneda et al.

[11] 4,057,146

[45] Nov. 8, 1977

[54] OPTICAL SORTING APPARATUS

[75] Inventors: Fernando Castaneda; Roy Jimenez, both of San Jose, Costa Rica

[73] Assignee: Xeltron, S.A., Jan Jose, Costa Rica

[21] Appl. No.: 568,761

[22] Filed: Apr. 16, 1975

[30] Foreign Application Priority Data

May 24, 1974 Costa Rica ..... 2770

[51] Int. Cl.[2] ..... B07C 5/342

[52] U.S. Cl. ..... 209/75; 209/111.6; 209/111.7 R; 250/226; 250/227; 350/63; 356/73; 356/207

[58] Field of Search ..... 209/75, 111.6, 111.7 R; 250/226, 227, 554; 356/72, 73, 178, 207; 350/63

[56] References Cited

U.S. PATENT DOCUMENTS

| | | | |
|---|---|---|---|
| 2,759,601 | 8/1956 | Baigent | 209/111.6 |
| 2,759,602 | 8/1956 | Baigent | 250/227 X |
| 2,881,919 | 4/1959 | Bartlett | 209/111.6 |
| 3,206,022 | 9/1965 | Roberts et al. | 209/111.6 X |
| 3,236,376 | 2/1966 | Boyce | 209/111.6 X |
| 3,283,896 | 11/1966 | Jirik et al. | 209/111.6 |
| 3,389,792 | 6/1968 | Anderson | 209/111.6 |
| 3,492,073 | 1/1970 | Michael | 209/111.6 X |
| 3,527,540 | 9/1970 | Bowker et al. | 250/226 X |
| 3,679,314 | 7/1972 | Mustert | 250/226 X |
| 3,750,883 | 8/1973 | Irving et al. | 209/111.6 |
| 3,770,111 | 11/1973 | Greenwood et al. | 209/111.6 X |
| 3,773,172 | 11/1973 | McClure et al. | 250/227 X |

*Primary Examiner*—Robert B. Reeves
*Assistant Examiner*—Joseph J. Rolla
*Attorney, Agent, or Firm*—Pollock, Vande Sande & Priddy

[57] ABSTRACT

Apparatus for optically sorting small light objects such as beans and/or grains on the basis of size and color. A feeding mechanism separates the objects one from another and delivers them in a free falling condition to an optical analysis means where each object is uniformly illuminated. The analysis is based on the amount and spectrum of reflected light which is conveyed to a pair of light transducers having different response characteristics. The electrical signals developed by the transducers are simultaneously analyzed for absolute values to determine object size and relative value of the integrated signals to determine object coloring.

An annular analysis head is employed with the objects being analyzed falling through the central opening. The head is comprised of a pair of annular rings with a predetermined gap between the rings located at the central opening. Plural fiber light conducting rods are uniformly spaced about the circumference of the gap so as to collect light reflected from the object. A pair of fiber bundles are formed, each made up of rods uniformly disposed about the circumference. Each bundle of the pair provides light to a different one of the transducers. Low pressure air introduced at the gap prevents dust or the like from masking the rod ends.

18 Claims, 14 Drawing Figures

OPTICAL SORTING APPARATUS

FIELD OF THE INVENTION

The present invention relates to optical sorting apparatus for sorting individual objects such as beans, grains, fruit and the like. More particularly it relates to apparatus in which a plurality of such objects are delivered, one at a time to an analysis means at which each of the objects is illuminated. The analysis is based on the reflected light which then controls the path over which the object travels.

BACKGROUND OF THE INVENTION

There are a wide variety of optical sorting systems which have been described in the prior art for sorting objects such as beans, grains, fruit and the like based on color and/or size. These systems are similar in that they have a feeding device for feeding the objects which also serve to separate the objects from each other. As the objects move into an analysis area they are illuminated and the light which is reflected from the objects is detected by one or more light detectors. If the analysis is to be based either in whole or in part on color there would be at least two detectors whose response characteristics, as a function of frequency, would be different. The detectors produce electrical signals which are related to the light which they detect and these electrical signals are then processed by electronic circuitry which gives an indication as to whether or not the object is acceptable. This signal is provided to a deflecting device which will deflect the object depending upon the signals received from the processing circuit.

Although a variety of systems of the type generally outlined above are available and described in the prior art a number of problems have not been solved and our invention is addressed to these problems. In particular, since the comparison system employs light detectors with differing response characteristics two light signals must be developed, one for each detector. In order that the analysis operate solely as a function of the light reflected from the object the two light signals should comprise only reflected light and should, furthermore, be identical. Prior art systems have employed complicated systems of lenses and dividing mirrors to perform this function which are not wholly satisfactory from the standpoint of cost and accuracy. It is also preferable to derive the reflected light from the entire surface of the object. Some prior art systems have had difficulty in obtaining reflected light from all or a majority of the surface of the object being analyzed.

A majority of the prior art systems of which we are aware determine acceptability of an object based upon color alone. That is, each of the nominally identical light signals is directed at a photodetector whose response characteristics peaks in different areas of the light spectrum. In this way, the output signal from each detector is indicative of the reflectance of the object at the wave lengths which the detectors output peaks. By comparing these signals; usually the ratio is determined, a quanity is developed which is characteristic of the object's color. By establishing predetermined limits only objects with nominally proper colors will be accepted, and others will be reflected. One difficulty with this approach is that object size is another factor which should be taken into account in determining whether it is acceptable or not. Clearly, signals which have been derived as is described above do not contain information relating to the size of the object and therefor will not serve to select objects only within predetermined size limits.

Since the analysis, which has been briefly described above, is based on light reflected from the object in an analysis zone, it is apparent that the analysis apparatus should operate only during the period when the object is illuminated. This synchronization function has, however, proved to be difficult when a number of analysis criteria are being employed. Thus, some prior art systems sense the object at a location preceding the analysis zone and enable the analysis apparatus a predetermined period after the object is sensed. For objects of nominal size which travel from the sensing location to the analysis zone in a nominal period of time the system, of course, works quite well. However, when objects vary in size and/or travel with variable speeds between the sensing location and the analysis zone difficulties occur in that the analysis circuitry is operating when the object is not correctly positioned. This, of course, leads to anamalous signals and may lead to erroneous operation.

Furthermore some systems, which rely solely on instantaneous reflected light, may be subject to erratic operation as a result of the complex nature of the signals.

SUMMARY OF THE INVENTION

Our invention overcomes the problems referred to above by providing a relatively simple system for segrating the light reflected from the objects being analyzed, developing two separate but identical light signals for at least two different detectors and transmitting only that light to the respective detectors. Briefly, the objects being analyzed pass through the central opening of an annular ring which is formed by a upper and lower annular rings. A cylindrical gap exists between the upper and lower rings and a plurality of optical fibers have their ends radially spaced from the cylindrical gap circumferentially around the ring. The objects being analyzed fall through the central opening in the annulus and are illuminated when they reach a plane adjacent to the gap. The other ends of the fiber objects are divided, randomly into two groups to direct light reflected from the objects to the two detectors. A low pressure source of air is fed into the gap so as to ensure that the fiber optic ends do not become masked by dust or other debris. By radially spacing the fiber optic ends in from the cylindrical gap we ensure that only light which is reflected from the object can reach the fiber optic.

The analysis apparatus subjects the electrical signals produced by the photodetectors to three different criteria. The relationship (ratio, difference, or the like) between the signals is compared to a reference and, only if the relationship produces a signal less then the reference will the object be accepted. Furthermore, the intensity of the reflected light is compared to an upper and lower standard. Only if the reflected intensity lies between the upper and lower intensity standards will the object be accepted. In order to prevent the generation of spurious signals the electronic apparatus is self synchronized in that synchronizing signals are derived from the signals generated by the reflected light itself. In this fashion the analyzing apparatus cannot be enabled when an object is not in the analysis zone.

We integrate the transducer signals by charging a capacitor before the relationship between the signals is determined. This integration supresses erratic operation and gives a better overall figure for the reflectance of the surface of the object which produces the signal that is integrated.

In one embodiment the synchronization circuit produces one read signal to the integrating circuits and subsequently an erase signal. In this fashion the integrated signal is related to the reflectance of the entire surface of the object. This is suitable for small objects such as beans, grain and the like.

On the other hand it is sometimes desirable, when large objects such as fruit are being sorted, to "slice" the transducer signals so that they relate to circumferential bands on the surface. Finer control of the sorting process is thus achieved. This action can be effected by modifying the synchronization circuit parameters so as to reduce the delay between the input and read signal. An erase signal follows the first read signal and then other read-erase signals are generated in succeeding time periods.

Although the difference circuit generates the difference between the capacitor voltage this can actually be proportional to the ratio of the object's reflectance at the peaks of the photodetectors response curves. To provide this result the amplification between photodetectors and integrating circuit is arranged to be non-linear and, more particularly, logarithmic. Of course the difference between two logarithms is the ratio of the values from which the logarithms were obtained.

Alternatively the difference circuit can be replaced by an analog divider to provide an output which is the required ratio of the respective reflectance values.

BRIEF DESCRIPTION OF THE DRAWINGS

In the drawings appended hereto like reference characters identify identical apparatus and.

DETAILED DESCRIPTION OF THE DRAWINGS

Figure 1:
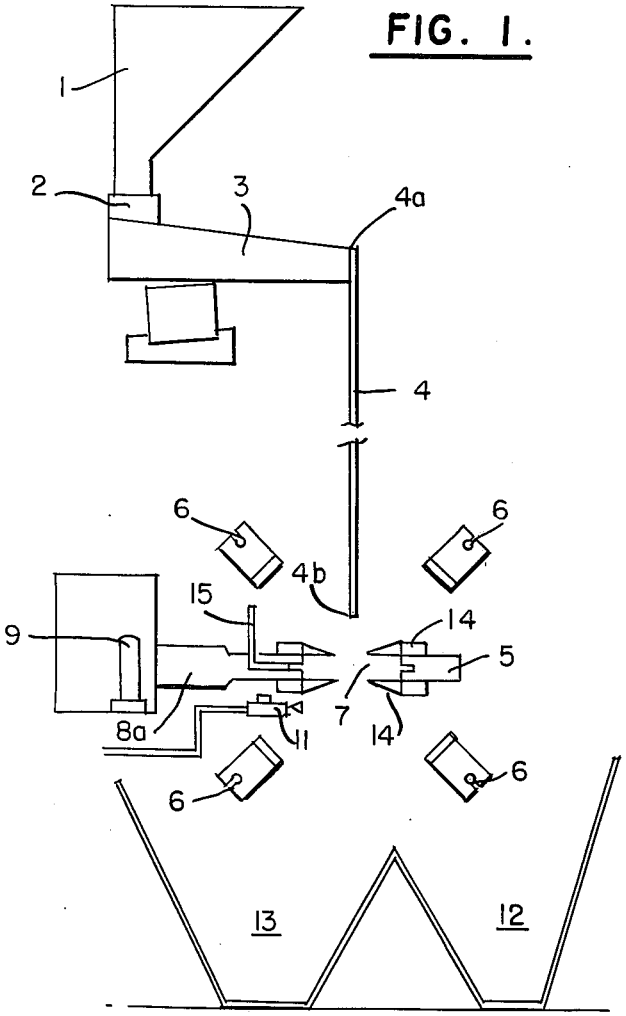
FIG. 1 is an end view of the assembled apparatus showing the relationship between the optical analyzing head and the path of the objects to be sorted.
Figure 2:
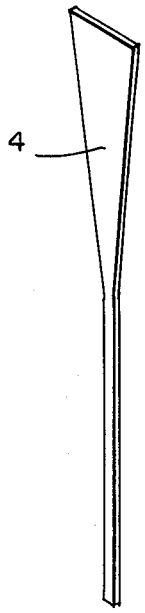
FIG. 2 is an isometric view of a channel which defines one portion of the path over which the objects to be sorted travel.

FIG. 1 is a schematic illustration of an optical sorting system employing the apparatus of our invention as adapted for sorting coffee beans, grains or the like. The objects to be sorted are loaded into a hopper 1 from which they pass in a controlled fashion to a vibrating tray 3. A gate 2 controls the rate at which objects pass from hopper 1 to the vibrating tray 3. The vibrating tray provides a continuous flow and a uniform distribution of the objects toward a vertically positioned channel 4. Channel 4 is of rectangular cross section at the inlet end 4A and of square cross section at the outlet end 4B. From the inlet end 4A the channel 4 narrows triangularly in one dimension until it obtains a square cross section halfway through its total length. The isometric view of the channel 4 in FIG. 2 illustrates the variation in cross section through the length of the channel. Channel 4 conveys the objects one by one and separates them from each other. This separation is due to the uniform acceleration of the objects as they fall downwardly under the influence of gravity. For example, if we feed the vibrating tray at the rate of 100 objects per second, the objects move over the tray which may be 10 centimeters in width at a rate of 10 objects per centimeter. In other words, there will be an average distance of 1 millimeter between the center of the objects. This separation will increase as the objects fall downwardly so that after a fall of approximately 120 centimeters, which may represent the length of channel 4, the separation between objects is 5 centimeters.

Located directly beneath the outlet end 4B of the channel 4 is the analysis zone which is defined by the analysis head 5. The analysis head 5 will be described in more detail with reference to FIG. 3. Suffice to say here that the analysis head 5 is in the form of an annulus with the central opening directly beneath the outlet end of the channel 4. The head is formed by a pair of annular rings comprising an upper and lower annular ring 14. A cylindrical gap exists between the inner ends of the annular rings 14 through which reflected light passes. The illumination is supplied by a plurality of illuminating lamps 6. The reflected light, which enters the cylindrical gap between the annular rings 14 is conveyed to a plurality of photodetectors, represented in FIG. 1 by the photodetector 9. The reflected light is conveyed to the photodetectors by a plurality of optical fibers which are identified by reference numeral 8A in FIG. 1. A low pressure source of compressed air supplied via air inlet 15 prevents dust and other debris from masking the light collecting ends of the optical fibers 8A.

A deflecting means 11 provides for selectively deflecting objects immediately after they have passed through the analysis zone. In particular, the deflecting means illustrated in FIG. 1 comprises a solenoid valve 11 controlled by the output of the electronic signal processing apparatus. The solenoid valve 11 is connected to a compressed air supply at a pressure of approximately 5 to 10 kilograms per square centimeter. When the valve is opened an air jet is produced to deflect an object toward a hopper 12 which forms the rejection hopper. If the object is not to be rejected, but is to be accepted, the valve is not actuated and the object falls directly into the acceptance hopper 13.

Figure 3B:
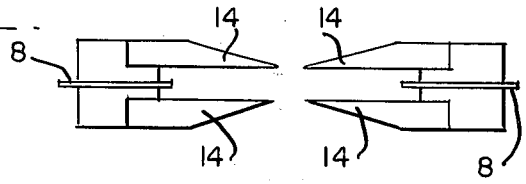
FIG. 3B is a cross sectional view of the optical analysis head.
Figure 3A:
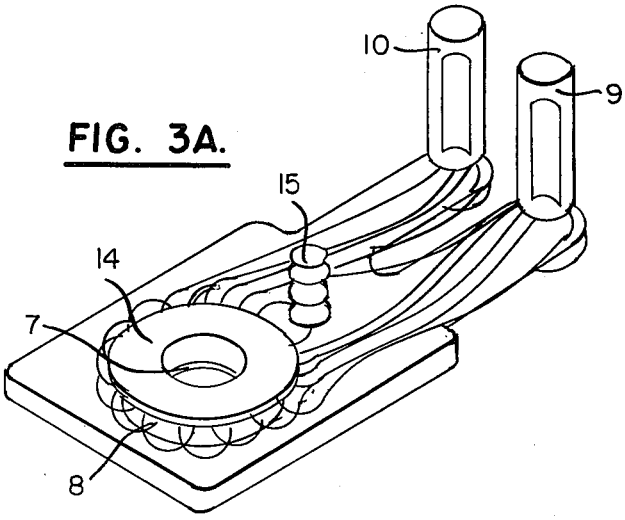
FIG. 3A is an isometric view of the optical analysis head and associated photodetector.
Figure 4A:
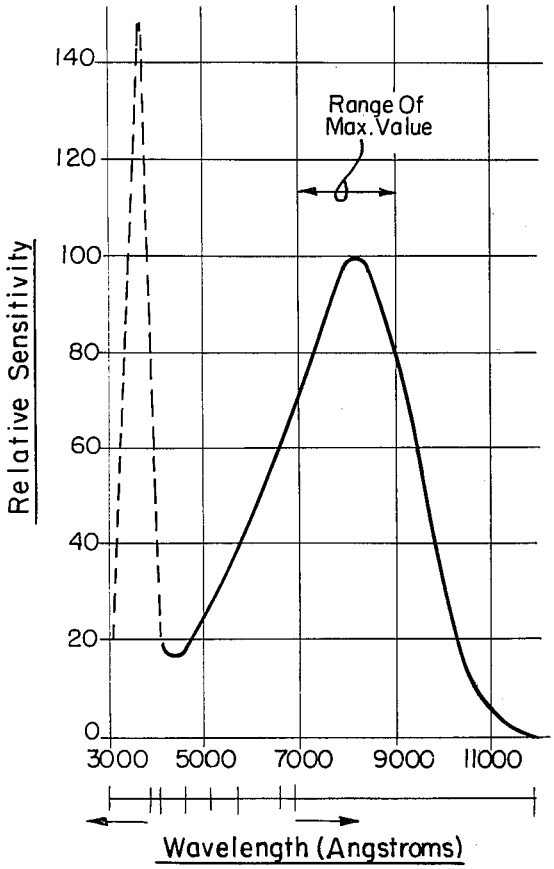
FIGS. 4A and 4B show typical response characteristics for suitable photodetectors.
Figure 4B:
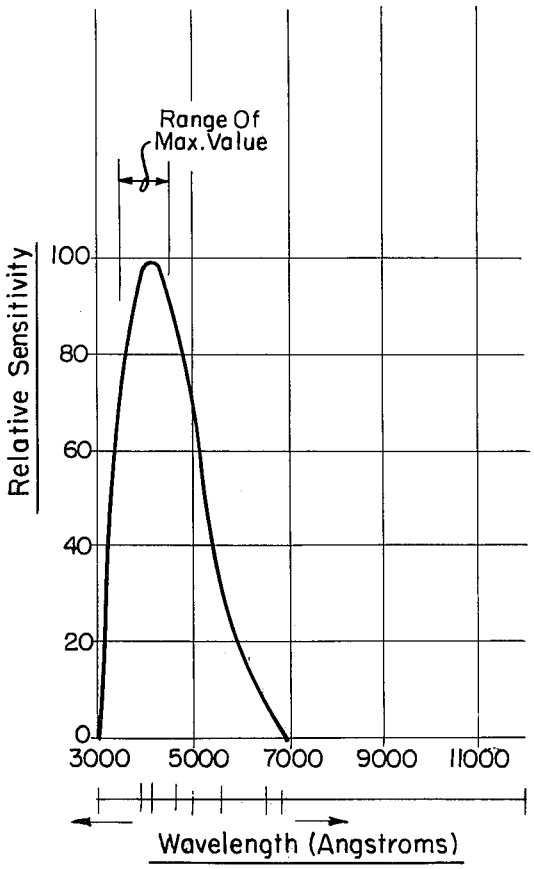

FIG. 3A illustrates the optical analyzer in detail and shows its cooperation with the photodetectors. FIG. 3B is a cross section of FIG. 3A showing only the analysis head. As shown in FIGS. 3A and 3B a pair of parallel rings 14, displaced from one another define a gap therebetween as well as a central opening through which the objects can pass in their travel through the analysis apparatus. Typically the gap can have a dimension of 1 millimeter in the direction of travel of the objects and, for small beans and/or grain the central opening in the annulus may have a diameter of 45 millimeters. As shown in FIG. 3A a plurality of optical fibers 8 have one end located in the gap and radially offset from the central opening of the annulus. Illumination from the lamps 6 illuminates the central opening of the annulus. Since the optical fiber ends are radially offset from the central opening, however, the illumination does not directly fall on them. To effect this the angle between the axis of the light beam, from any light source, and the plane of the optical fibers is between 30° and 80°, and preferably 45°. An air inlet 15 provides a source of low pressure air to the gap between the rings 14. Preferably this air is supplied at a pressure of 0.01 kg/cm$^2$ in order to prevent settling of dust and debris in the gap which would have the effect of masking the optical fibers. As shown in FIG. 3A the optical fibers and air channels are encapsulated in plastic resin to facilitate handling of the analysis head. Those of ordinary skill in the art will appreciate that the optical fibers will transmit light reflected from the object as it passes through the analysis head. As shown particularly in FIG. 3A the optical fibers are divided into two bundles which are directed to two different photocells 9 and 10. These photocells or detectors have different electronic response to radiation as shown by the response curves illustrated in FIGS. 4A and 4B. The optical fibers are selected for each of the bundles so that the end of the optical fibers associated with the gap in one bundle are randomly interspersed with the ends of the optical fibers associated with the gap in the other bundle. In this fashion, each of the photodetectors receives essentially the same illumination but, due to the different characteristics produces a different electrical response. However, since the reflections energizing both photodetectors are the same, the electrical response from each of the photodetectors is synchronized with each other. By reason of the construction of the analysis head only light reflected from the object being analyzed is received by the optical fibers and transmitted to the photodetectors. Since there is no background radiation, processing of the electrical signals is simplified.

Figure 5:
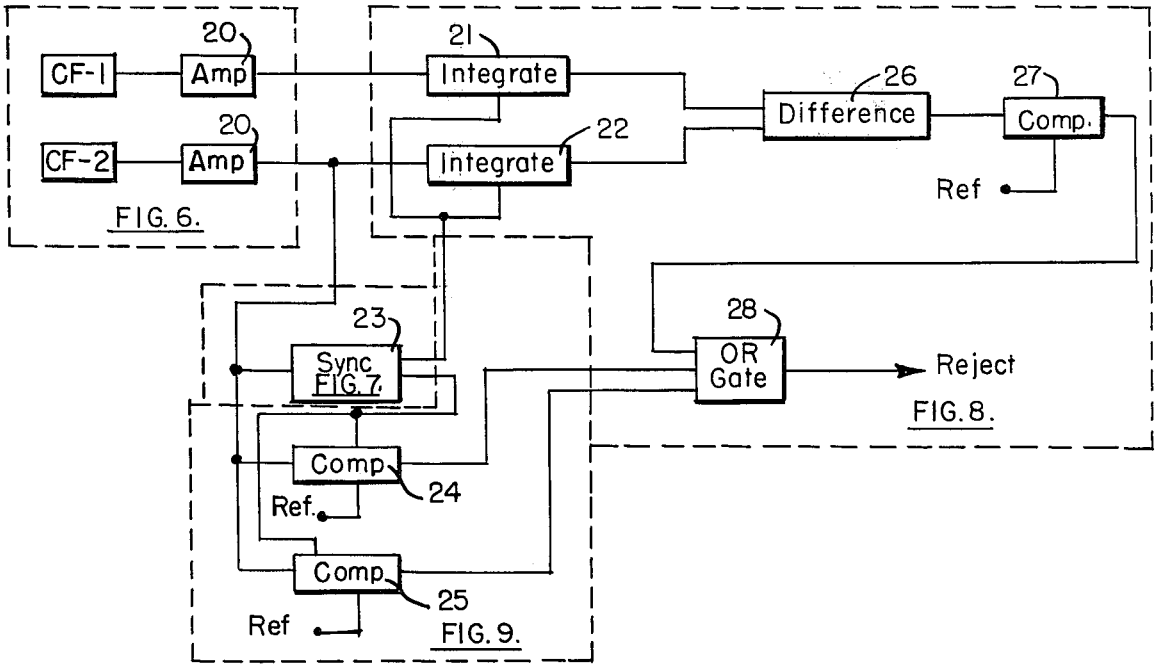
FIG. 5 is a block diagram of the electronic analysis circuitry.

In order to understand the manner in which the optical sorting apparatus processes the electrical signals generated by the photodetectors 9 and 10 reference is made to the block diagram of FIG. 5 for explaining the philosophy of the system before referring to the schematic diagrams of FIGS. 6–9. FIG. 5 illustrates a pair of photodetectors CF-1 and CF-2 which corresponds to the photocells 9 and 10 illustrated in FIG. 3. An amplifier 20 is connected to the output of each of the photodetectors and the output of each amplifier is connected to one of two integrating circuits 21 and 22. The output of one of the amplifiers is also connected as an input to a synchronizing circuit 23 and a pair of comparators 24 and 25. The integrators operate under control of signals from the synchronizing circuit 23 and, at the proper time, provide inputs to a differencing circuit 26 which also operates in response to synchronizing circuit 23. One of the comparators is also controlled by signals from the synchronizing circuit 23. Each of the comparators 24 and 25 has a different reference input signal. Comparator 24 produces an output signal if and only if the input signal is below the reference and comparator 25 produces an output signal if and only if the input signal is above the reference input. A further comparator circuit 27 has provided thereto, as an input, the output of the differencing circuit 26 and another reference signal. The comparator 27 produces an output if and only if its input is above the reference input. Finally, an OR gate 28 produces a reject signal if and only if it receives a signal from one or more of the comparators 24, 25 and 27.

The acceptance criteria is based upon the relationship between the signals produced by CF-1 and CF-2 as well as the absolute value of these signals. The relationship of the two signals is determined by the differencing circuit 26 and comparator 27. If the difference between, or the ratio between, the actual signals developed by CF-1 and CF-2 is too great the output of comparator 27 produces an input to OR gate 28 to cause the object producing these signals to be rejected. The absolute value of one of the signals is monitored by comparators 24 and 25. One comparator produces an output if the signal is too low and the other comparator produces an output if the signal is too large. Since the relationship between the two signals is monitored as well as the absolute value of one, the absolute value of the other signal is implicitly monitored. That is, the comparators will produce an output signal if the output of CF-2 is too large or too small. However, if the output of CF-2 is within the proper range but, it is the output of CF-1 which is too large or too small then, of course the comparators 24 and 25 will not produce an output. However, the comparator 27 will produce such an output to reject the object whose reflection resulted in the signals produced by CF-1 and CF-2.

The light related signal produced by either amplifier 20 is a function of the size and color of the object reflecting the light which is directed to the photo detector as well as the intensity of the illumination and the detectors response characteristic. As an example, employing four 10 watt lamps for illumination and a gain of approximately 350 in amplifier 20 we obtain approximately 4–9 volts as a light related signal of acceptable magnitude. A signal of 1–3 volts is considered a bad dark object and 10–15 volts is considered a bad light object.

Figure 6:
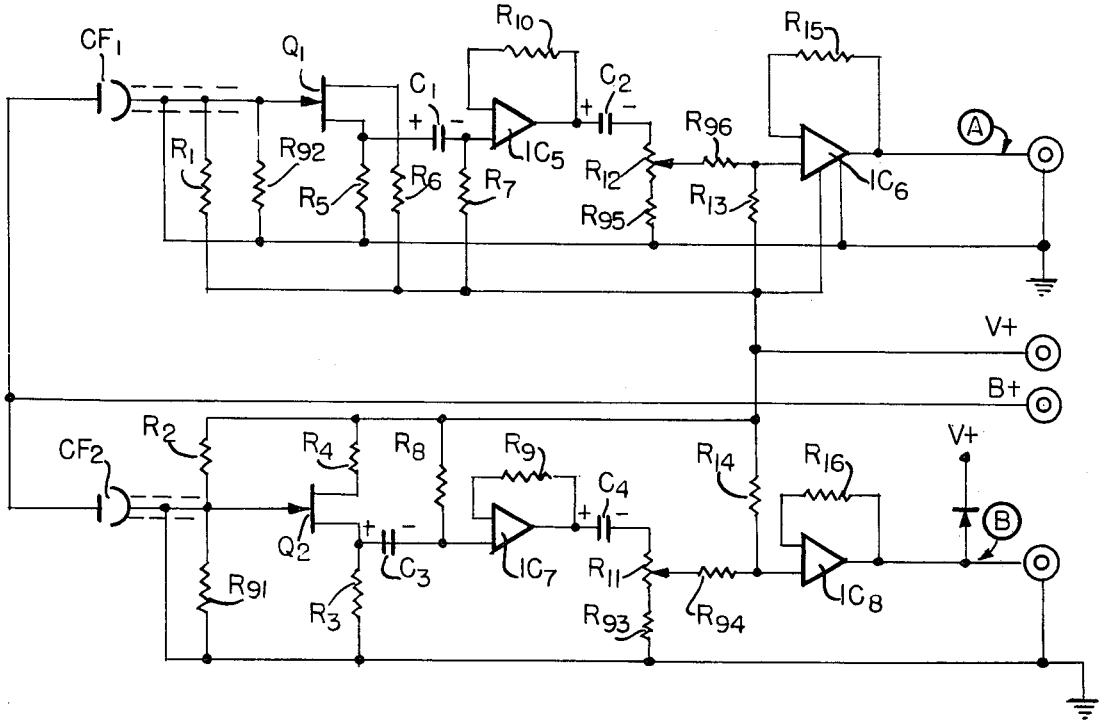
FIG. 6 is a schematic diagram showing the photodetectors and associated amplifiers.
Figure 9:
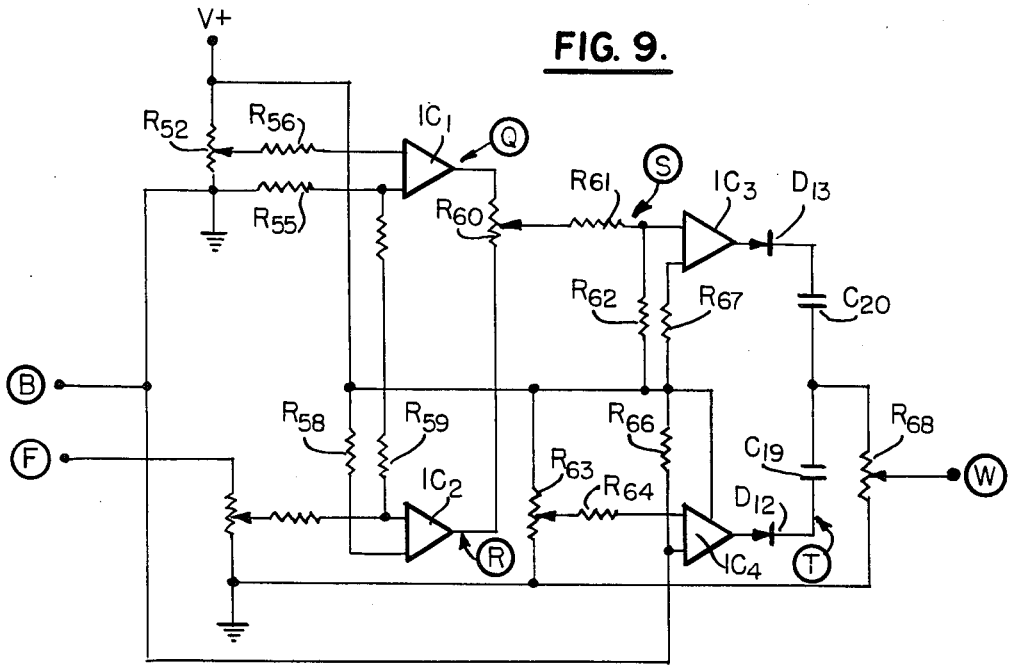
FIG. 9 is a schematic diagram of a pair of comparitors.
Figure 7:
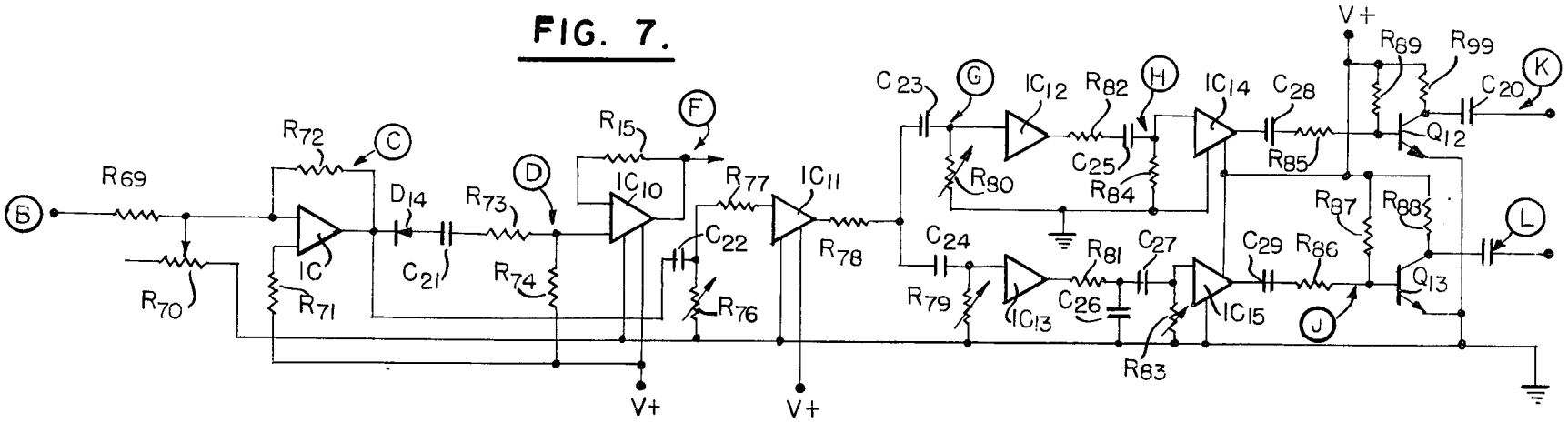
FIG. 7 is a schematic diagram of the synchronization circuit.
Figure 8:
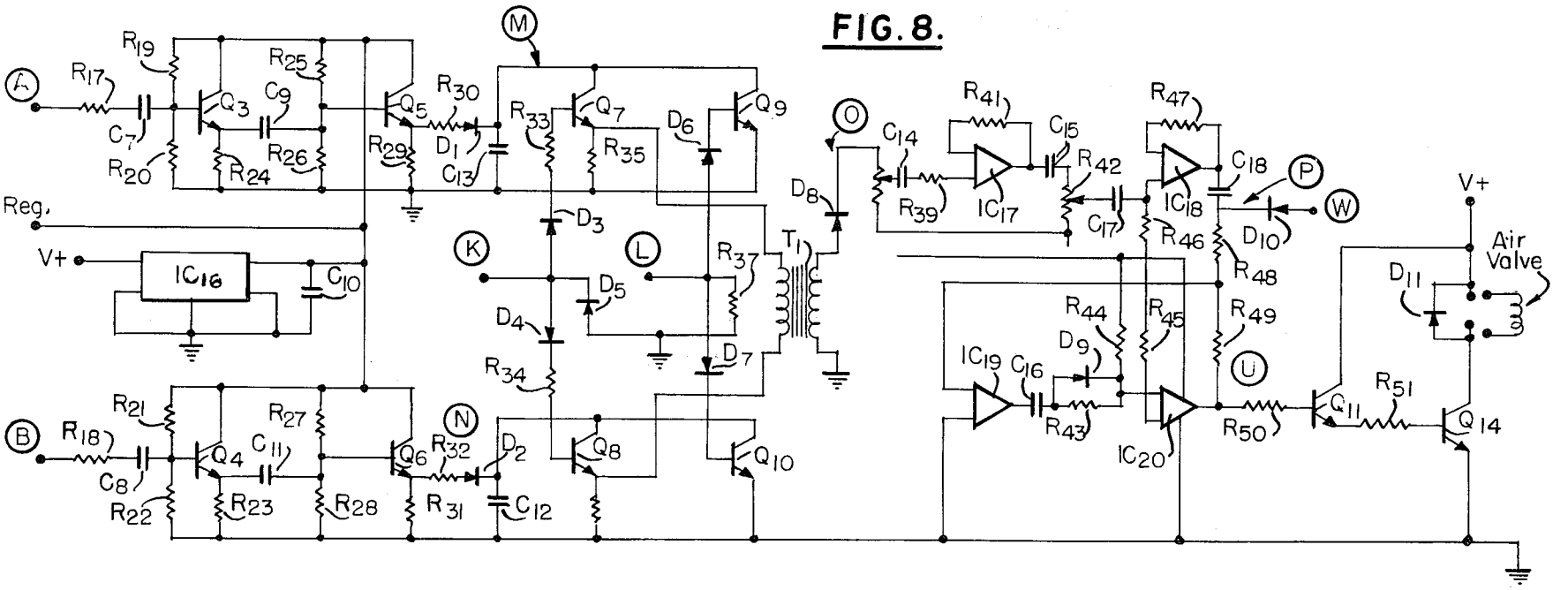
FIG. 8 is a schematic diagram of the integrating means, differencing circuit, comparator, OR gate and the reject apparatus.

Prior to discussing the circuits schematic in detail we note, as illustrated in FIG. 5, that the apparatus corresponding to CF-1, CF-2 and amplifiers 20 are illustrated in FIG. 6, the synchronizing circuit 23 is illustrated in FIG. 7, the apparatus that corresponds to integrators 21, 22, differencing circuit 26, comparator 27 and OR gate 28 is illustrated in FIG. 8 and the comparators 24 and 25 are illustrated in FIG. 9.

As is illustrated in FIG. 6 the photodetectors CF-1 and CF-2 are connected each to an amplifier. More particularly, the amplifier connected to CF-1 comprises FETQ1, IC-5 and IC-6 and the components associated therewith; the output of this amplifier is available at point A. Correspondingly, the amplifier connected to CF-2 comprises FETQ2, IC-7, IC-8 and the components associated therewith. The output of this amplifier is available at point B in the circuit. The potentiometer R-12, connected to the output of IC-5, and the potentiometer R-11, connected to the output of IC-7 are adjusted during calibration, so that objects with acceptable color will produce voltages at point A and B which are nominally equal.

Although in FIG. 6 and in FIGS. 7 through 9 we illustrate electronic circuits employing integrated circuits those of ordinary skill in the art will understand that these circuits could be realized from discrete elements employing either solid state active devices or vacuum tube type devices. The integrated circuits are, however, preferable from the standpoint of cost, size, power drain and ease of assembly.

FIG. 7 illustrates the synchronizing circuit 23. This apparatus has a single input which may be derived from either one of the amplifiers 20. As is illustrated in FIG. 7 the input is connected to point B (FIG. 6) which is the output of IC-8. The synchronizing circuit produces an output for comparator 24, which is derived at point F, shown in FIG. 7. In addition, signals are provided to the integrating circuits 21 and 22 via points K and L, also shown in FIG. 7. As will be explained below the comparators 24 and 25 compare the instantaneous absolute value of the output from an amplifier 20 with predetermined reference labels. Since it is desired to produce an output from the comparators if the instantaneous absolute value of the amplifier output lies outside the limit imposed by the reference levels the synchronizing input to the comparator 24 must enable the comparison to be effected only so long as the amplifier produces an output signal. Of course comparator 25 needs no synchronizing signal since it cannot produce an output in the absence of an input from one of the amplifiers. In order to provide such a synchronizing signal the input (from point B of FIG. 6) is provided to an amplifier IC-9 whose output is a slightly squared pulse of negative polarity. This signal is applied through the cathode of diode D-14, capacitor C-21 and resistor R-73 as an input to IC-10 which amplifies the signal to saturation and produces positive rectangular pulses of uniform amplitude. The duration of the positive pulse produced at point F is related to the amplitude and duration of the signal applied from point B which is of course derived from the objects reflection producing a signal in CF-2. Thus, the signal at point F is self synchronized to the period of time the object is reflecting light into the photodetectors. The output at point F is provided as the synchronizing input to the comparator circuitry illustrated in FIG. 9.

The remaining portion of the synchronizing circuit of FIG. 7 is provided to develop a pair of properly timed output signals for each of the integrators 21 and 22. The first of these output signals is a read pulse which allows the integrators to provide an output signal in order that the differencing circuit 26 can provide a difference therebetween. The second of the two output signals serves to discharge completely the integrating circuits so that they are ready for the next cycle of operation. The manner in which these two signals are produced will now be explained.

The output of IC-9, the slightly rectangular negative pulse is provided as an input to IC-11, through a differentiating circuit comprising capacitor C-22 and R-76. The effective input therefore, to IC-11 is a positive pulse. The output of IC-11 is, therefore, a negative pulse of short duration. This pulse is applied to a pair of differentiating circuits comprised, on the one hand of capacitor C-23 and R-80 and, on the other hand, capacitor C-24 and R-79. Each of these circuits produce positive pulses which are provided respectively to integrated circuits IC-12 and IC-13. Each of these circuits develops a negative pulse which is delayed in time with respect to IC-11. The time delays are established by R-80 and R-79 respectively. The negative output signals from IC-12 and IC-13 are provided to still further differentiating circuits comprising, on the one hand C-25 and R-84 and, on the other hand C-27 and R-83. The output of each of these circuits is again positive pulse which is fed either to IC-14 or IC-15. These integrated circuits produce rectangular pulses whose duration can be adjusted by R-84 and R-83 respectively. The output of IC-14 is, after traversing C-28 and R-85 fed to the base of transistor Q-12, where it is inverted. Similarly, the output of IC-15 is fed to the base of transistor Q-13 through C-29 and R-86, where it is inverted. Thus a positive pulse of adjustable duration and adjustable delay is available at terminals K and L of the synchronizing apparatus. The manner in which the duration and delays are selected will become clear after the discussion of the operation of FIG. 8, the circuit in which these pulses are employed.

FIG. 8 includes the schematics for integrators 21 and 22, differencing circuit 26, comparator 27 and OR gate 28.

In particular, the integrator 21 includes transistors Q-3, Q-5, capacitor C-13, transistor Q-7 and associated componentes. Likewise, integrator 22 includes transistor Q-4, transistor Q-6, capacitor C-12, transistor Q-8 and associated components. The input signals to this apparatus are connected at input points A and B, which are in turn connected to the output points A and B of FIG. 6. This, of course, comprises the amplified output of the photodetectors CF-1 and CF-2. Transistors Q-3 - Q-6 merely amplify the input signals and provide then, through diodes D-1 and D-2 to charge capacitor C-13 and C-12, respectively. The amplified signals produced by the photodetectors thus charge capacitor C-12 and C-13 and the accumulation of the charge on the capacitors perform the integration function. At the conclusion of the measuring interval, as determined by the synchronizing circuits, switching transistors Q-7 and Q-8 are enabled by the output pulse K which is coupled from the K output of the synchronizing apparatus (FIG. 7) to the K input of the integrators. This pulse, coupled through diodes D-3 and D-4 to the bases of transistors Q-7 and Q-8 enables these transistors to conduct. The emmitters of transistors Q-7 and Q-8 are connected to opposite terminals of a primary winding of a transistor T-1.

The transformer T-1 comprises the differencing circuit 26. Of course, if there is a difference in voltage on the capacitor C-12 and C-13 at the time that transistors Q-7 and Q-8 are enabled, current will flow through the primary winding of transformer T-1 in the direction from the capacitor with the greater voltage toward the capacitor with the smaller voltage. This flow of current will be proportional to the difference in voltage on the two capacitors. The current flow in the winding will induce a voltage into the other winding of transformer T-1 which will be provided, through diode D-8 as an input to IC-17. The output of IC-17 is fed through potentiometer R-42 to IC-18. If the voltage available at the tap of potentiometer R-42 is above the threshold potential determined by the voltage source +V connected through R-46 and C-17, IC-18 will produce a rectangular pulse indicating that the object is unacceptable. Thus, IC-17 and IC-18 correspond to the comparator 27. The output of IC-18 is fed as an input to monostable multi-vibrator comprising IC-19 and IC-20. This multivibrator produces a rectangular output pulse with duration between 2 and 10 milliseconds which is then provided as an input to power transistor Q-11 whose output enables switching transistor Q-14 to energize the solenoid valve to cause the object to be rejected. Thus, the monostable multivibrator comprising IC-19 and IC-20 as well as transistors Q-11 and Q-14 comprise the OR gate 28.

In order to provide a sharply defined output of transformer T-1 capacitor C-12 and C-13 are grounded microseconds after transistors Q-7 and Q-8 are enabled. This is provided by the output pulse from synchronizing circuit which is available at point L and connected, through diodes D-6 and D-7 to transistors Q-9 and Q-10.

As is illustrated in FIG. 5 OR gate 28 is also provided with inputs from comparators 24 and 25. Reference to FIG. 9 will illustrate the schematic details of comparators 24 and 25.

FIG. 9 illustrates the details of the comparators. Two inputs are provided to this circuit, the first at input B which is connected to the output B (FIG. 6) and the second is input F which is connected to the output F (FIG. 7). Of course, the latter of these two inputs is the synchronizing input. The synchronizing input is fed, through potentiometer R-53 to both IC-1 and IC-2. One comparator corresponds to IC-1 to which is applied a reference input derived from potentiometer R-52. If the input signal at point B is higher than the reference potential set by potentiometer R-52, IC-1 amplifies the signal. The output of IC-1 (Q) is a positive potential signal which is applied to potentiometer R-60. At the same time, synchronized with the operation of IC-1, IC-2 has applied to it a signal from point F (FIG. 7). Amplifier IC-2 produces a rectangular pulse (R) of negative polarity in response to its inputs. This is also applied to potentiometer R-60. Potentiometer R-60 is so adjusted that its output (S) will be negative only in the absence of an output from IC-1 which indicates that the signal applied at point B was less than the threshold value set by potentiometer R-52. The output of potentiometer R-60 is amplified by IC-3 and fed to diode D-13 and capacitor C-20, the output of which is connected to point W.

The same input signal provided to IC-1 is also provided, through resistor R-65 to IC-4 which forms the second comparator. This signal is compared with the reference potential provided by potentiometer R-63 which is connected to a positive source of potential plus V. IC-4 produces an output (T) only if the input at point 8 is above the threshold voltage set at R-63. This output voltage is fed through diode D-12 and capacitor C-19 is also provided to output point W through potentiometer R-68.

Thus, a voltage will be produced at potentiometer R-68 if and only if the input signal at point B is either below a threshold set at R-52 or above the upper threshold set at R-63. The output of point W forms another input to the OR gate, at point W (FIG. 8).

Figure 10A:
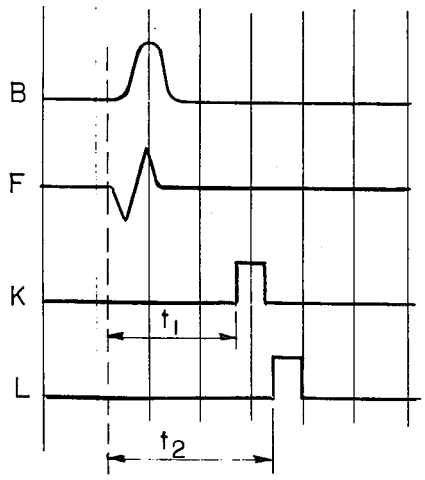
FIGS. 10A through 10C show representative wave forms at various points in the circuits.

In order to provide further insight into the operation of the circuits FIG. 10A illustrates certain representative waveforms and the relationship therebetween related to the synchronizing apparatus of (FIG. 7). The letter designations heretofore and hereafter used for signals refer to the reference letters indicated on FIGS. 6–9 of the drawings indicating the circuit point at which the signal occurs. In particular, a typical input signal B is illustrated which is representative of the amplified signals developed by one of the photodetectors. As has been mentioned, with respect to FIG. 7, a first synchronizing signal F is produced which is generally contemperaneous with the signal B. This signal F is illustrated in FIG. 10A as well. Furthermore, the K (or read) signal is provided for comparing the voltage on the capacitors C-12 and C-13 (FIG. 8). This signal K is illustrated in FIG. 10A as being delayed from the beginning of the B signal by a time T-1 which is determined by R-80 (FIG. 7). The specification also indicates that shortly after the voltage on the capacitors has been read they are discharged to ground by the signal L (erase), which is also illustrated in FIG. 10A. The L signal occurs at time T-2 subsequent to the beginning of the B signal. The time T-2 is adjustable via R-79 and is generally set to occur about 1 microsecond subsequent to the beginning of the pulse K. The duration of both pulses K and L are determined respectively by resistors R-84 and R-83.

Typical values for the time delays T-1 and T-2 can be determined as follows, for the representative case of sorting coffee beans. These beans are approximately 0.5 to 1.0 centimeters in length. With the inner diameter of the annulus of the analyzing head, selected at approximately 35 millimeters, and with a gap length of 1.5 millimeters, employing optical fibers whose ends form a circle with a diameter of 55 millimeters, with each of the optical fibers having a diameter of 3 millimeters the photodetectors "see" a cylindrical band 3 millimeters high. Under these conditions, and with the previously established velocity the grain takes 4 milliseconds to pass through the analyzing head. Therefor, the read pulse (K) is generated 3.5 milliseconds after the circuit responds to the appearance of the grain. Thus, T-1 would equal 3.5 milliseconds. The condensors can be read in approximately 0.1 milliseconds and thus the time T-2, which is the delay between the response of the apparatus to the appearance of the grain and the L (or erase signal) can be selected at 3.6 milliseconds.

Figure 10C:
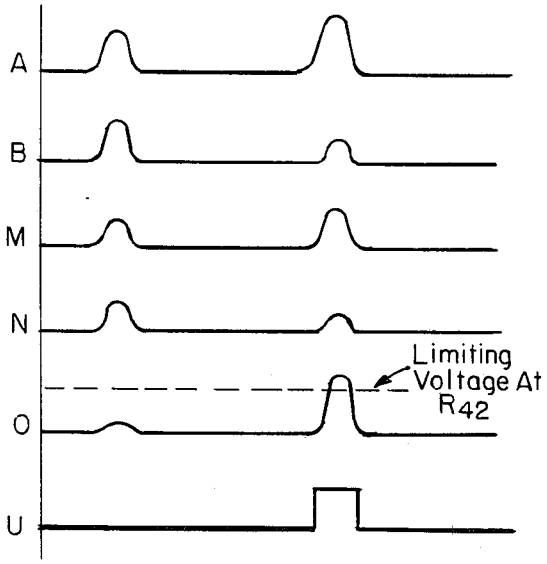
Figure 10C:
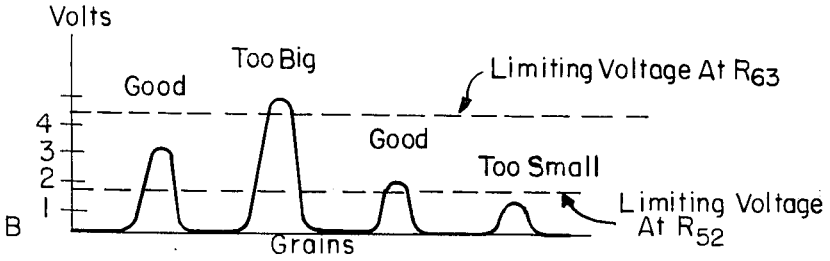
Figure 10B:
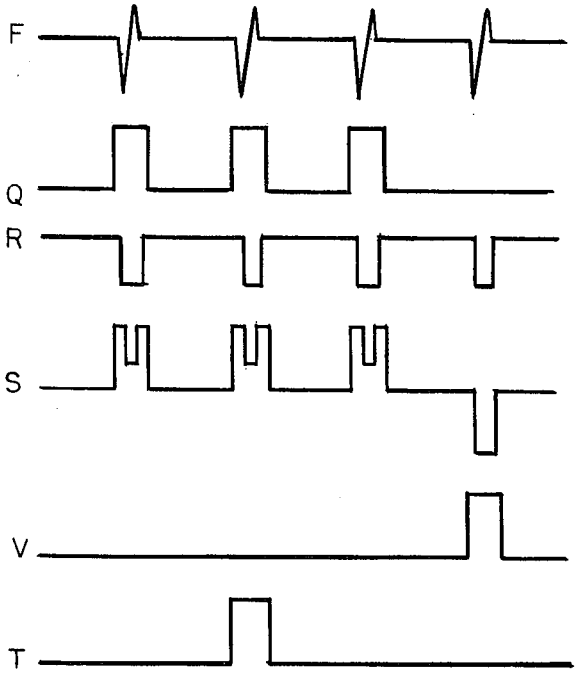

FIG. 10B illustrates typical wave forms in connection with the comparators illustrated in FIG. 9 for four separate cases. Each of the pulses in a single vertical column are generated in response to the B pulse at the top of that column. Thus, the B signals in left to right order illustrate a good response, an excessive response, another good response and an insufficient response. Of course, the synchronizing signal F is identical in each case. The Q signal is present for each of the cases except for the insufficient response. The R signal is also present regardless of the magnitude of the input. The S signal which is the sum of the R and Q signals is negative only for the case in which the Q signal is absent. As a direct result of the negative S signal in a case in which the B input is insufficient, a V signal is present whereas in the case of the excessive response a T input is present. Regardless of whether the signal be T or V, a W signal will be produced as an input to an OR gate to cause the object to be rejected.

FIG. 10C illustrates typical wave forms in connection with the apparatus illustrated in FIG. 8. As was the case with FIG. 10B, those signals in a vertical column are associated one with the other and the two vertical columns illustrate two different relationships. The particular cases illustrated in FIG. 10C may produce A and B signal amplitudes which are in the range set by the limits in the circuit illustrated in FIG. 9. However, the A signal in the second case is approaching the upper end of the limit where the B signal in the second case approaches the lower end of the limit. As a result, the relationship between these signals, after integration, produces an 0 signal which exceeds the limiting voltage set by R-42. As a result, a U signal or a rejection signal is produced in the second case to deflect the object from the acceptance bin to the rejection bin.

As has been explained, with respect to FIG. 8, the output of transformer T-1 is a signal which is proportional to the difference in voltage accumulated on the capacitor C-12 and C-13. The voltage accumulated on these capacitors is a direct result of the amplified output signals from each of the photodetectors. If each of the amplification stages were linear, the output would then merely be related to the difference in reflectance of the object at the peak of the response characteristics of the two photodetectors. However, if transistors Q-5 and Q-6 are chosen as logging transistors the amplification is then, of course, non-linear. In this regard, a logging transistor has an output which is a logarithmic function of its input (see U.S. Pat. No. 3,700,918 and Motorola application note AN-261a(1971). Such transistors are commercially available, such as Motorola 2N2222. When such logging transistors are included as transistors Q-5 and Q-6 then, of course, the voltage accumulated on the capacitor C-12 and C-13 would each be logarithmically related to the photodetector outputs. The output of transformer T-1 would then be the difference between the two logarithms. Those of ordinary skill in the art will understand that the difference between two logarithms is equal to the ratio of values from which logarithms were determined. In this fashion, then, the output of transformer T-1 is proportional to the ration between the outputs of detectors CF-1 and CF-2.

As an alternative the transistors Q-5 and Q-6 need not be selected as logging transistors. Instead, each of the amplifier stages between the photodetectors CF-1 and CF-2 and the condensors C-12 and C-13 can be chosen as linear. However, in this embodiment, transformer T-1, including both primary and secondary windings are deleted. Instead an analog dividing circuit can be provided, which circuit may comprise an integrated circuit. Such dividing circuits are commercially available, see Motorola specification MC 1594L. The output of the divider, will of course, give the ratio between the outputs of the detectors CF-1 and CF-2. This ratio can then be compared against a preestablished reference or threshold level in a comparator circuit such as those illustrated in this application to determine whether or not the object is acceptable or not.

The calibration of the various potentiometers employed for establishing threshold or reference limits is accomplished as follows. We employ a calibrator which includes a light emitting diodes (LEDS) of different colors; red and green would be used for coffee beans the LED outputs are directed to the optical fibers in the analysis head. By adjusting the voltage supply to the different LEDS we can adjust the light output of each. First energizing only one of the two LEDS, for instance the green LED with a predetermined voltage we adjust potentiometer R-12 to obtain, at point A, a given voltage. We then energize the other LED, for instance the red LED and adjust potentiometer R-11 to get the same value at point B. Then energizing both LEDS with a predetermined voltage we should obtain a cancellation signal or 0 voltage output of transformer T-1. Then, by varying the input voltages to the LEDS, so that first one is high and the other is low, and then vice versa we can adjust potentiometers R-52 and R-63 for the maximum and minimum settings.

In actual field operations, instead of employing the calibration means referred to above the optical sorting apparatus can be fed with grains that have color and size within the minimum size limits and potentiometer R-60 is adjusted so that the sorting apparatus accepts such grains. The optical sorting apparatus is then fed with grains of the maximum size to be allowed as acceptable and potentiometer R-63 is accordingly adjusted. Finally, the machine is fed with good grains of nominal size, and potentiometers R-11 and R-12 are adjusted to give a nominally 0 output of transformer T-1.

In the foregoing description of our invention we have employed the term transducers, photodetectors and the like to refer to the devices which respond to reflections of the objects to be sorted and produce electrical outputs. Although the drawings illustrate vacuum tube devices, those of ordinary skill in the art will understand that solid state devices such as silicon and selenium photocells, silicon phototransistors, photo multiplier cells and the like could be used instead. Furthermore, although we have disclosed employing light transducers with different response characteristics it should also be understood that this arrangement is deemed equivalent to employing transducers with a broad response characteristic and different light filters to provide the selectivity.

What is claimed is:

1. Optical sorting apparatus for sorting objects falling over an unimpeded path in response to light reflected from said objects including, a pair of light detecting means with different response characteristics producing a pair of light related signals, processing means for integrating said pair of light related signals and for producing an output if a relationship between said integrated light related signals exceeds a first threshold, comparator means receiving as an input, one of said pair of light related signals and producing an output if, and only if, said input signal lies outside of a predetermined range, synchronization means responsive to one of said pair of light related signals and connected to said processing means and to said comparator means for enabling both said processing means and comparator means only in the presence of said one of said pair of light related signals, and reject means responsive to output signals from both said processing means and said comparator means to reject an object if an output signal is provided by either said processing means of said comparator means.

2. The apparatus of claim 1 in which said processing means includes, a pair of integrators, each including a capacitor to integrate one of said light related signals by accumulating a charge thereon, a pair of switches, said switches connecting each of said capacitors to circuit means for determining a relationship between voltages on said capacitors when said switches are closed, and means connecting said switches to said synchronization means.

3. The apparatus of claim 2 in which each of said light detecting means includes a light responsive transducer and means responsive to said light responsive transducer for supplying to said integrators a voltage logarithmically related to the ouput of said light responsive transducer.

4. The apparatus of claim 3 in which said circuit means determines the difference between said voltages.

5. The apparatus of claim 4 in which said circuit means comprises a transformer.

6. The apparatus of claim 2 in which said circuit means determines the ratio of voltages on said capacitors.

7. The apparatus of claim 6 in which said circuit means comprises an analog divider.

8. The apparatus of claim 1 wherein said pair of light detecting means includes a pair of parallel annular rings located so that said objects pass through the central opening of each of said rings, said rings being spaced apart to provide a gap therebetween, a plurality of optical fibers with one end of each said fibers located in said gap, said one end of each of said optical fibers spaced from the others circumferentially about an axis through said central opening parallel to the path of travel of said object, each of said optical fiber ends radially spaced outward from the inner edge of each of said rings, said plurality of optical fibers divided into a pair of optical fiber bundles, and a pair of light transducers, each optically associated with one of said pair of bundles.

9. The apparatus of claim 8 in which low pressure air means is connected to supply low pressure air to said gap to prevent dust or other debris from masking said ends of said optical fibers.

10. The apparatus of claim 8 in which said rings are located so that only light reflected from said objects reaches said optical fiber ends.

11. Self-synchronized optical sorting apparatus for sorting objects in response to light reflected from said objects including, a pair of light detecting means with different response characteristics producing a pair of light related signals, a pair of integrating means for providing integrated signals in response to light related signals produced by said light detectors, and circuit means for producing an output if, and only if, the difference between said pair of integrated signals exceeds a first predetermined value, a pair of comparator means, each provided with an identical input signal selected from one of said pair of light related signals, one of said comparator means producing a signal if, and only if, said input signal is below a second predetermined value, said other comparator means producing a signal if, and only if, said input signal exceeds a third predetermined value, synchronizing means connected to both said integrating means and said one comparator means for producing a pair of synchronizing signals to enable said pair of integrating means and said one comparator means, said synchronizing means receiving, as an input signal, a signal selected from one of said pair of light related signals, and reject means for deflecting said objects in response to an output signal from said pair of integrating means or said one or other comparator means.

12. The apparatus of claim 11 wherein each of said integrating means includes a capacitor to integrate one of said light related signals by accumulating a charge thereon, a pair of switches, said switches connecting each of said capacitors to said circuit means for determining the difference between voltages on said capacitors by reason of the charge accumulated thereon when said switches are closed, said means connecting said switches to said synchronizing means.

13. The apparatus of claim 12 in which each of said light detecting means includes a light responsive transducer and means responsive to said light responsive transducer for supplying light related signal which is logarithmically related to the output of said light responsive transducer.

14. The apparatus of claim 13 in which said circuit means comprises a transformer.

15. The apparatus of claim 11 wherein said pair of light detecting means includes a pair of parallel annular rings located so that said objects pass through the central opening of each, said rings being spaced apart to provide a gap therebetween, a plurality of optical fibers with one end of each located in said gap and each spaced from the other circumferentially about an axis through said central opening parallel to the path of travel of said objects and each of said optical fiber ends radially spaced outward from the inner edge of each of said rings, said plurality of optical fibers divided into a pair of optical fiber bundles and a pair of light transducers, each operatively associated with one of said bundles.

16. The apparatus of claim 15 in which low pressure air means is connected to supply low pressure air to said gap to prevent dust and/or other debris from masking ends of said optical fibers.

17. Optical sorting apparatus including a stationary analysis head for providing reflected light from a falling object to a light responsive transducer over an unimpeded path including a plurality of light sources, spaced about said head, for illuminating said falling object, said head comprising:

a pair of parallel annular rings spaced apart to thereby define a gap therebetween with a central axis of each ring substantially co-linear with the path of said falling object, a plurality of optical fibers each having one end located in said gap between said rings and each spaced circumferentially one from another about said axis, each of said ends receiving reflected light unimpeded by any object, each of said ends spaced radially outward from the inner edge of said ring, and low pressure air means for slightly increasing air pressure adjacent said ends to prevent dust and/or other debris from masking said ends, said low pressure air means having a discharge opening adjacent said fiber ends and located in said gap.

18. The apparatus of claim 17 in which said plurality of optical fibers are divided into a pair of optical fiber bundles, said bundles being selected so that optical fiber ends associated with one bundle are randomly interspersed with optical fiber ends associated with said other bundle.

* * * * *